US007694757B2

(12) United States Patent
Keshavan

(10) Patent No.: US 7,694,757 B2
(45) Date of Patent: Apr. 13, 2010

(54) THERMALLY STABLE POLYCRYSTALLINE DIAMOND MATERIALS, CUTTING ELEMENTS INCORPORATING THE SAME AND BITS INCORPORATING SUCH CUTTING ELEMENTS

(75) Inventor: Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 647 days.

(21) Appl. No.: 11/361,079

(22) Filed: Feb. 22, 2006

(65) Prior Publication Data

US 2006/0191723 A1 Aug. 31, 2006

Related U.S. Application Data

(60) Provisional application No. 60/655,650, filed on Feb. 23, 2005.

(51) Int. Cl.
*E21B 10/52* (2006.01)

(52) U.S. Cl. ..... 175/434; 175/433; 175/374; 76/108.4

(58) Field of Classification Search ..... 175/434, 175/374, 433, 425, 428; 76/108.2, 108.4
See application file for complete search history.

(56) References Cited

U.S. PATENT DOCUMENTS

| | | | | |
|---|---|---|---|---|
| 4,224,380 | A | 9/1980 | Bovenkerk et al. | |
| 4,403,015 | A | 9/1983 | Nakai et al. | |
| 4,505,746 | A | 3/1985 | Nakai et al. | |
| 4,604,106 | A * | 8/1986 | Hall | 51/293 |
| 4,636,253 | A | 1/1987 | Nakai et al. | |
| 4,664,705 | A * | 5/1987 | Horton et al. | 75/243 |
| 4,850,523 | A | 7/1989 | Slutz | |
| 5,096,465 | A * | 3/1992 | Chen et al. | 51/295 |
| 5,135,061 | A | 8/1992 | Newton, Jr. | |
| 5,510,193 | A | 4/1996 | Cerutti et al. | |
| 5,833,021 | A | 11/1998 | Mensa-Wilmot et al. | |
| 5,853,873 | A * | 12/1998 | Kukino et al. | 428/336 |
| 5,887,580 | A | 3/1999 | Eyre | |
| 5,889,219 | A * | 3/1999 | Moriguchi et al. | 75/236 |
| 6,054,693 | A | 4/2000 | Barmatz et al. | |
| 6,132,675 | A | 10/2000 | Corrigan et al. | |
| 6,193,001 | B1 | 2/2001 | Eyre et al. | |
| 6,216,805 | B1 * | 4/2001 | Lays et al. | 175/374 |
| 6,258,139 | B1 * | 7/2001 | Jensen | 51/307 |
| 7,350,601 | B2 * | 4/2008 | Belnap et al. | 175/434 |

(Continued)

FOREIGN PATENT DOCUMENTS

| | | |
|---|---|---|
| EP | 0 196 777 A1 | 10/1986 |

(Continued)

OTHER PUBLICATIONS

Radtke, Robert et al., Faster Drilling, Longer Life: Thermally Stable Diamond Drill Bit Cutters, *Summer 2004 Gas Tips*, 2004, pp. 5-9.

*Primary Examiner*—Kenneth Thompson
(74) *Attorney, Agent, or Firm*—Christie, Parker & Hale, LLP

(57) ABSTRACT

A cutting element is provided including a substrate and a TSP material layer over the substrate. The TSP material layer includes at least a property having a value that varies through the layer.

52 Claims, 7 Drawing Sheets

U.S. PATENT DOCUMENTS

| | | | | |
|---|---|---|---|---|
| 2003/0235691 | A1 | 12/2003 | Griffin et al. | |
| 2006/0060392 | A1 * | 3/2006 | Eyre | 175/434 |
| 2008/0178535 | A1 * | 7/2008 | Wan | 51/297 |

FOREIGN PATENT DOCUMENTS

| | | | | |
|---|---|---|---|---|
| EP | 0 352 811 | A1 | | 1/1990 |
| GB | 2261894 | A | | 6/1993 |
| GB | 2 270 492 | A | | 3/1994 |
| GB | 2 418 215 | A | | 3/2006 |
| WO | WO 2004106003 | A1 | * | 12/2004 |
| WO | WO 2004106004 | A1 | * | 12/2004 |

* cited by examiner

THERMALLY STABLE POLYCRYSTALLINE DIAMOND MATERIALS, CUTTING ELEMENTS INCORPORATING THE SAME AND BITS INCORPORATING SUCH CUTTING ELEMENTS

CROSS-REFERENCE TO RELATED APPLICATION

This application claims is based upon and claims priority on U.S. Provisional Application No. 60/655,650, filed on Feb. 23, 2005, the contents of which are fully incorporated herein by reference.

BACKGROUND OF THE INVENTION

The present invention is directed to thermally stable polycrystalline diamond (TSP) materials and to the engineered TSP materials having desired properties that may vary through the material thickness and/or width and to such materials forming the cutting layers of tools such as the cutting layers of cutting elements used in earth boring bits.

A conventional cutting element 1, such as a shear cutter mounted on an earth boring bit typically has a cylindrical cemented carbide body 10, i.e. a substrate, having an end face 12 (also referred to herein as an "interface surface"), as for example shown in FIG. 1. An ultra hard material layer 18, such as polycrystalline diamond (PCD) or polycrystalline cubic boron nitride (PCBN) is bonded on the interface surface forming a cutting layer. The cutting layer can have a flat or curved interface surface 14. Cutting elements are mounted on pockets 2 of an earth boring bit, such a drag bit 7, at an angle 8, as shown in FIGS. 1 and 2 and contact the earth formation 11 during drilling along edge 9 over cutting layer 18.

Generally speaking, the process for making a cutting element employs a substrate of cemented tungsten carbide where the tungsten carbide particles (also referred to as "grains") are cemented together with cobalt. The carbide body, i.e., substrate, is placed adjacent to a layer of ultra hard material particles (grains) such as for example diamond or cubic boron nitride (CBN) within a refractory metal enclosure, typical referred to as a "can", as for example a niobium can, and the combination is subjected to a high temperature at a high pressure where diamond or CBN is thermodynamically stable. This process is referred to as a high pressure high temperature sintering process. This results in the re-crystallization and formation of a polycrystalline diamond or polycrystalline CBN ultra hard material layer on the cemented tungsten carbide substrate, i.e., it results in the formation of a cutting element having a cemented tungsten carbide substrate and an ultra hard material cutting layer. The ultra hard material layer, if made from polycrystalline diamond (PCD), may include tungsten carbide particles and/or small amounts of cobalt. Cobalt promotes the formation of PCD. Cobalt may also infiltrate the diamond from the cemented tungsten carbide substrate.

The cemented tungsten carbide substrate is typically formed by placing tungsten carbide powder (i.e., grains) and a binder in a mold and then heating the binder to its melting temperature causing the binder to melt and infiltrate the tungsten carbide grains fusing them together and cementing the substrate. Alternatively, the tungsten carbide powder may be cemented by the binder during the high temperature, high pressure process used to re-crystallize the ultra hard material layer. In such case, the substrate material powder along with the binder are placed in the can, forming an assembly. Ultra hard material grains are provided over the substrate material to form the ultra hard material polycrystalline layer. The entire assembly is then subjected to a high temperature, high pressure process forming the cutting element having a substrate in a polycrystalline ultra hard material layer over it.

With many of the aforementioned cutting elements, the cutting layer is not efficient for all types of earth formation drillings. Similarly, with other types of cutting tools, the cutting layers of such cutting tools are not efficient for the various types of cutting that they are used. As such, a cutting element or cutting tool having a cutting layer which is engineered for a specific cutting task is desired.

SUMMARY OF THE INVENTION

In an exemplary embodiment a cutting element is provided including a substrate and a TSP material layer over the substrate. The TSP material layer includes at least a property having a value that varies through the layer. In one exemplary embodiment, the property value varies axially though the layer. In another exemplary embodiment, the property value varies transversely across the layer. In a further exemplary embodiment, the property value varies in a radial direction. In yet a further exemplary embodiment, the layer includes a thickness and the property value that varies axially and radially through the thickness. In an exemplary embodiment, the property is selected from the group of properties consisting of material strength and transverse rupture strength.

In another exemplary embodiment, the TSP layer includes a first section adjacent a second section. The first section includes diamond particles (grains) having a first average grain size. The second section includes diamond grains having a second average grain size such that the second average grain size is greater than the first average grain size. In yet another exemplary embodiment, the TSP layer further includes a third section. The third section includes diamond grains having a third average grain size such that the third average grain size is greater than the second average grain size.

In yet a further exemplary embodiment, each section defines a layer, such that the first section defined layer is further from the substrate than the second section defined layer which is further from the substrate than the third section defined layer. In one exemplary embodiment, the first average grain size is in the range of about 0.01 to about 2 microns, the second average grain size is in the range of about 3 to about 30 microns, and the third average grain size is in the range of about 40 to about 100 microns. In another exemplary embodiment, the first average grain size is in the range of about 0.1 to about 0.2 microns, the second average grain size is in the range of about 8 to about 15 microns, and the third average grain size is in the range of about 50 to about 70 microns. In yet another exemplary embodiment, the first average grain size is in the range of about 4 to about 30 microns, the second average grain size is in the range of about 40 to about 100 microns, and the third average grain size is greater than about 100 microns. In yet a further exemplary embodiment, the first average grain size is in the range of about 8 to about 15 microns, the second average grain size is in the range of about 50 to about 70 microns, and the third average grain size is greater than about 70 microns.

In another exemplary embodiment, each section defines a layer. With this embodiment, the third section is closest to the substrate, the second section is formed over the third section, and the first section is formed over the second section. In a yet a further exemplary embodiment, the first section encapsulates the second section and the second section encapsulates the third section. In yet a further exemplary embodiment, the three sections extend side by side defining the TSP material layer.

In one exemplary embodiment, the TSP layer includes a first section adjacent a second section. The first section includes a first porosity, and the second section includes a second porosity greater than the first porosity. In another exemplary embodiment, the TSP material layer further includes a third section having a third porosity greater than the second porosity. In a further exemplary embodiment, each section defines a layer. With this exemplary embodiment, the first section defines a first layer, the second section defines a second layer, and the third section defines a third layer such that the second layer is over the third layer and such that the first layer is over the second layer. Moreover, with this exemplary embodiment, the first layer has a porosity in the range of about 1% to about 7%, the second layer has a porosity in the range of about 7% to about 11% and the third layer has a porosity that is greater than about 11%. In another exemplary embodiment, the three layer define a TSP cutting layer having a first surface and second surface opposite the first surface such that the second surface is closer to the substrate and such that the first layer defines the first surface. With this exemplary embodiment, the first layer has a thickness that extends axially from the first surface to a depth of no greater than about 0.2 mm, the second layer has a thickness that extends axially from the first layer to a depth of no greater than about 1 mm as measured from the first surface, and the third layer has a thickness that extends from the second layer.

In another exemplary embodiment, the TSP material includes a transverse rupture strength of at least 150 kg/mm$^2$. In a further exemplary embodiment, the TSP material includes a transverse rupture strength of at least 180 kg/mm$^2$. In another exemplary embodiment, the TSP material includes a transverse rupture strength of at least 200 kg/mm$^2$. In yet another exemplary embodiment the TSP material includes a transverse rupture strength in the range of 150 kg/mm$^2$ to about 200 kg/mm$^2$. In either of the aforementioned exemplary embodiments, the TSP material layer may have diamond grains having a grain size in the range of about 10 to about 100 microns.

In one exemplary embodiment, the TSP material layer includes in the range of 20% to 95% by volume diamond grains having a grain size no greater than 1 micron. In another exemplary embodiment, the TSP material layer includes in the range of 95% to 99% diamond grains.

In one exemplary embodiment, the TSP material layer includes a first surface opposite a second surface such that the first surface is farther from the substrate than the second surface. With this exemplary embodiment, the TSP material layer includes diamond grains such that the grains proximate the second surface have a higher average grain size than the grains proximate the first surface. In another exemplary embodiment, the density of the TSP layer varies in an axial direction.

In yet another exemplary embodiment, the substrate includes a projection and the TSP material layer surrounds the projection. In a further exemplary embodiment, the TSP material layer includes a plurality of sub-layers surrounding the projection and such that each sub-layer has a property having a value different from a value of the same property of an adjacent sub-layer.

In a further exemplary embodiment, the TSP material layer includes at least two sections, each section including a property where the value of the property in the first section is different from the value of the same property in the second section. In another exemplary embodiment, the value of each property is constant in each section. In yet a further exemplary embodiment, the TSP layer includes an edge, such that the second section defines at least a portion of the edge. In another exemplary embodiment, the TSP layer includes an upper surface and a peripheral surface extending along a periphery of the layer such that each of the sections extends to both the upper surface and to the peripheral surface. In yet another exemplary embodiment, the TSP layer includes a third section having the same property having a value different from the values of the property in the first and second sections. The third section also extends to the upper surface and to the peripheral surface of the TSP layer.

In another exemplary embodiment a cutting element is provided including a substrate, and a cutting layer formed over the substrate. The cutting layer includes a portion defining a cutting edge, which portion is formed from a TSP material including at least a property having a value that varies through the TSP material. In another exemplary embodiment, only the portion of the cutting layer is formed from the TSP material.

In yet a further exemplary embodiment, a drill bit is provided including a body and any of the aforementioned exemplary embodiment cutting elements mounted thereon.

DETAILED DESCRIPTION OF THE INVENTION

Figure 1:
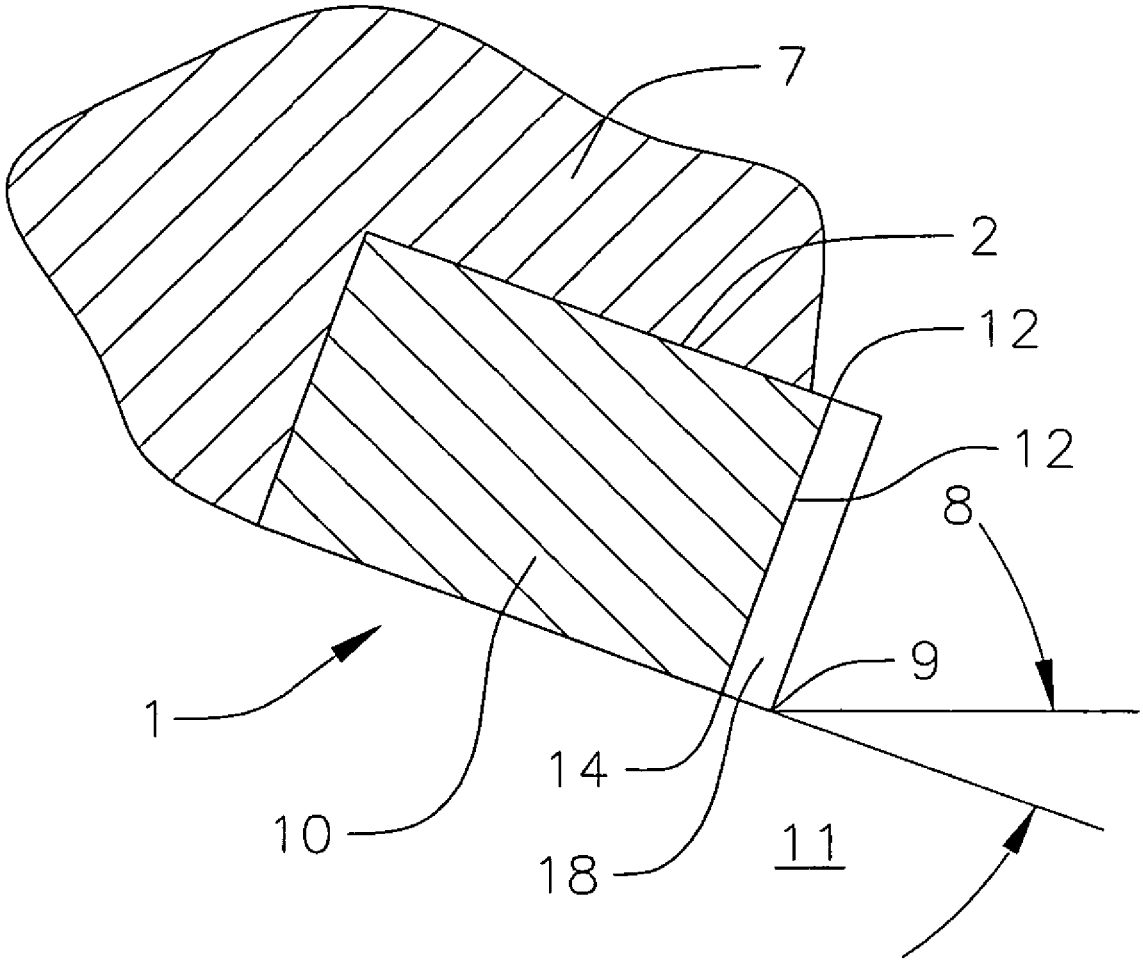
FIG. 1 is a cross-sectional view taken along arrow 1-1 in FIG. 2, depicting a cutting element mounted on a bit body.
Figure 2:
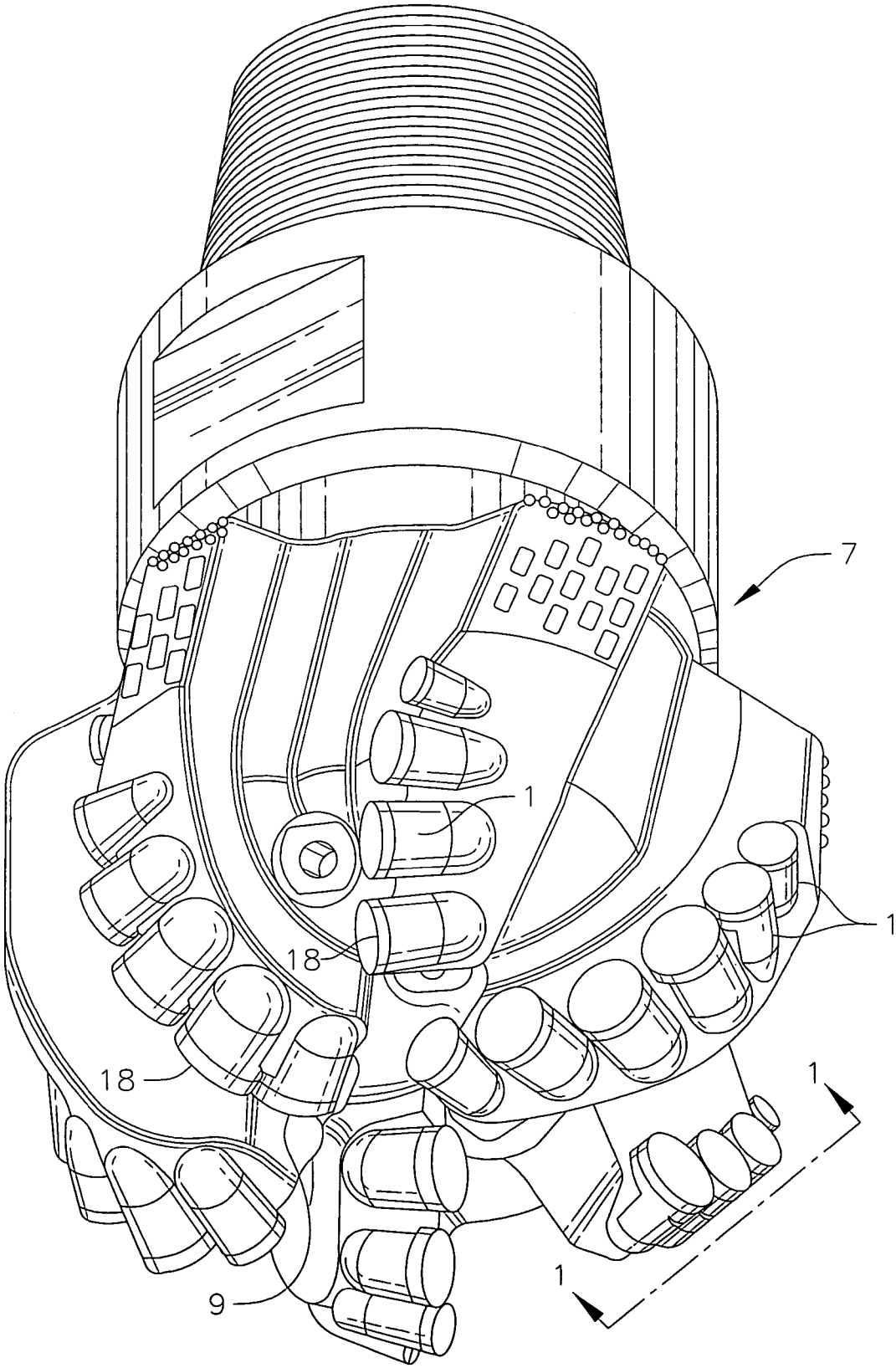
FIG. 2 is a prospective view of a bit incorporating cutting elements.

Engineered thermally stable polycrystalline diamond ("TSP") materials are provided. In one exemplary embodiment, a TSP material is formed by "leaching" the cobalt from the diamond lattice structure of polycrystalline diamond. When formed, polycrystalline diamond comprises individual diamond crystals that are interconnected defining a lattice structure. Cobalt particles are often found within the interstitial spaces in the diamond lattice structure. Cobalt has a significantly different coefficient of thermal expansion as compared to diamond, and as such, upon heating of the polycrystalline diamond, the cobalt expands, causing cracking to form in the lattice structure, resulting in the deterioration of the polycrystalline diamond layer. Polycrystalline diamond having a 2nd phase metal catalyst will generally not have thermal stability at temperatures above 700° C.

By removing, i.e., by leaching, the cobalt from the diamond lattice structure, the polycrystalline diamond layer becomes more heat resistant. However, the polycrystalline diamond layer also becomes more brittle. Accordingly, in certain cases, only a select portion, measured either in depth and/or width, of the polycrystalline layer is leached in order to gain thermal stability without losing impact resistance.

In another exemplary embodiment, TSP material is formed by forming polycrystalline diamond with a thermally compatible silicon carbide binder instead of cobalt. "TSP" as used herein refers to either of the aforementioned types of TSP materials.

These TSP materials may be used to form cutting layers for cutting tools, as for example cutting elements such as shear cutters. When forming a cutting tool or cutting element, to prevent cobalt from the carbide substrate of the cutting tool or cutting element from infiltrating the TSP material layer, the TSP material layer may be formed separate and is then bonded to the carbide substrate by using various appropriate methods such as brazing methods. In one exemplary embodiment, a TSP material layer is brazed to a substrate using microwave brazing as for example described in U.S. Pat. No. 6,054,693, the contents of which are fully incorporated herein by reference and in the paper entitled "Faster Drilling, Longer Life: Thermally Stable Diamond Drill Bit Cutters" by Robert Radtke, Richard Riedel, and John Hanaway, published on page 5 of the Summer 2004 edition of GasTIPS, the contents of which are fully incorporated herein by reference. Other methods of bonding include high pressure high temperature brazing, furnace or vacuum brazing, LS bonding or other standard methods, as for example the method described in U.S. Pat. No. 4,850,523, the contents of which are fully incorporated herein by reference.

In one exemplary embodiment, a cutting element is provided having a cutting layer, at least a portion of which is formed from any of the TSP materials described in U.S. Pat. Nos. 4,224,380; 4,505,746; 4,636,253; and 6,132,675 which are fully incorporated herein by reference. The cutting layers may span across the entire interface surface of a substrate or across only a partial portion of the interface surface of the substrate. In any of these embodiments, the TSP material may brazed to the substrate using any of the aforementioned brazing methods.

In a further exemplary embodiment, a TSP material is provided having a porosity between 1% and 7% and/or density between about 93-99%. This can be accomplished by using various diamond grain (particle) size distribution and various reduction temperatures (i.e., the temperatures of heating during sintering) as necessary to form the material. In another exemplary embodiment, a TSP material is provided having 20% to 85% by volume diamond grains having a grain size greater than 3 microns and binder making up the remainder volume. In an exemplary embodiment, the TSP material includes 20% to 95% by volume of ultra fine diamond grains with a grain size no greater than 1 micron. The binder used in either of the aforementioned exemplary embodiments also includes at least one compound selected from the group of carbides, carbonitrides, nitrides, and borides of the group IVA, VA, and VIA elements of the periodic table which form a solid solution or a mixture thereof. The binder may also include at least one member selected from the iron group metals.

In yet a further exemplary embodiment a TSP material is provided having a diamond content in excess of 95% and not more than 99% by volume, and a residue including at least a metal or a carbide selected from the groups IVA, VA, and VIA of the periodic table, and an iron group metal of 0.1 to 3% by volume in total. This exemplary embodiment TSP material has a porosity of at least 0.5% and not more than 5% by volume. Exemplary diamond grain size distribution and reduction temperatures are provided in U.S. Pat. Nos. 4,403,015 and 4,636,253 which are fully incorporated herein by reference.

The requisite TSP material density may also be obtained by mixing different grain sizes of diamond and/or by using different reduction temperatures and reduction times. For example, if a powder is reduced between 1400° C. to 1600° C. in a vacuum, the amount of graphitization will depend on the grain size and the amount of time during which the grains are exposed to the reduction temperature.

In another exemplary embodiment, a TSP material is provided having a transverse rupture strength of at least 150 $kg/mm^2$. In yet another exemplary embodiment, a TSP material is provided having a transverse rupture strength of at least 180 $kg/mm^2$. In a further exemplary embodiment, a TSP material is provided having a transverse rupture strength of about 200 $kg/mm^2$. In a further exemplary embodiment, a TSP material is provided a transverse rupture strength in the range of about 150 to about 200 $kg/mm^2$. In another exemplary embodiment, in either of the aforementioned exemplary embodiments, the TSP material may have a diamond grain size between 10 to 100 microns. The requisite transverse rupture strength may be achieved by varying the reduction temperature, time and HPHT conditions during sintering.

Figure 3:
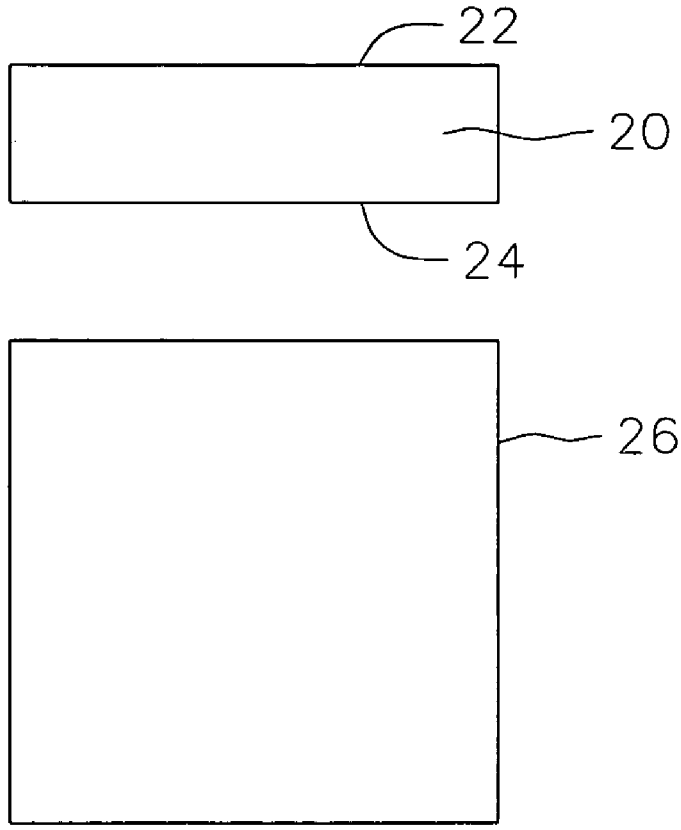
FIG. 3 is an exploded end view of an exemplary embodiment cutting element having an exemplary embodiment TSP material and a substrate.

In another exemplary embodiment a TSP material layer 20 is provided having a working surface 22 opposite an interface surface 24, i.e., a surface which will be bonded on to a substrate 26 (FIG. 3). The layer 20 has gradient properties which change from the TSP material working surface 22 to the interface surface 24. It should be noted that "gradient properties" or "varying properties" as used herein in relation to a material means one or more properties of the material whose value(s) vary or change through the material. In an exemplary embodiment, the gradient properties decrease from the working surface of the interface surface.

Figure 4:
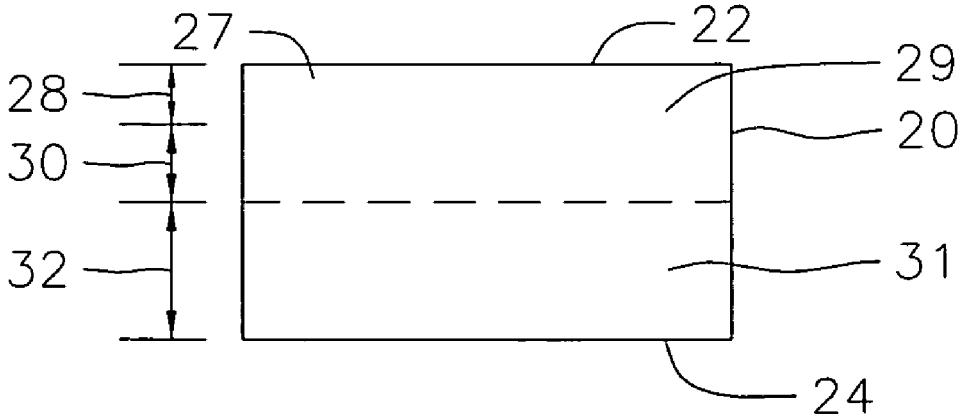
FIG. 4 is an end view of an exemplary embodiment engineered TSP material of the present invention having gradient properties.

In one exemplary embodiment, a TSP material layer is provided having a porosity between 1% and 7% at a section 27 beginning at the working surface 22 and extending to a depth 28 of at least 2 mm or 200 microns, as for example shown in FIG. 4. At a section 29 at a depth 30 of about 0.2 mm to about 1 mm as measured from the working surface, the porosity is between about 7% and about 11%. At a section 30 at a depth 32 from about greater than 1 mm as measured from the working surface to the interface surface, the TSP material has a porosity between 11 and 15%. As the porosity increases, the strength of the TSP material decreases. Consequently, with this exemplary embodiment, the higher strength TSP is placed at the cutting layer working surface.

A higher density TSP material is formed from a higher density PCD material. A higher density PCD material utilizes less cobalt binder. Consequently, less cobalt binder will need to be removed when forming a higher density TSP material than when forming a lower density TSP material. By using a higher density material at the working surface, applicants discovered that they are able to obtain an optimum combination of wear resistance, strength and toughness.

Figure 5:
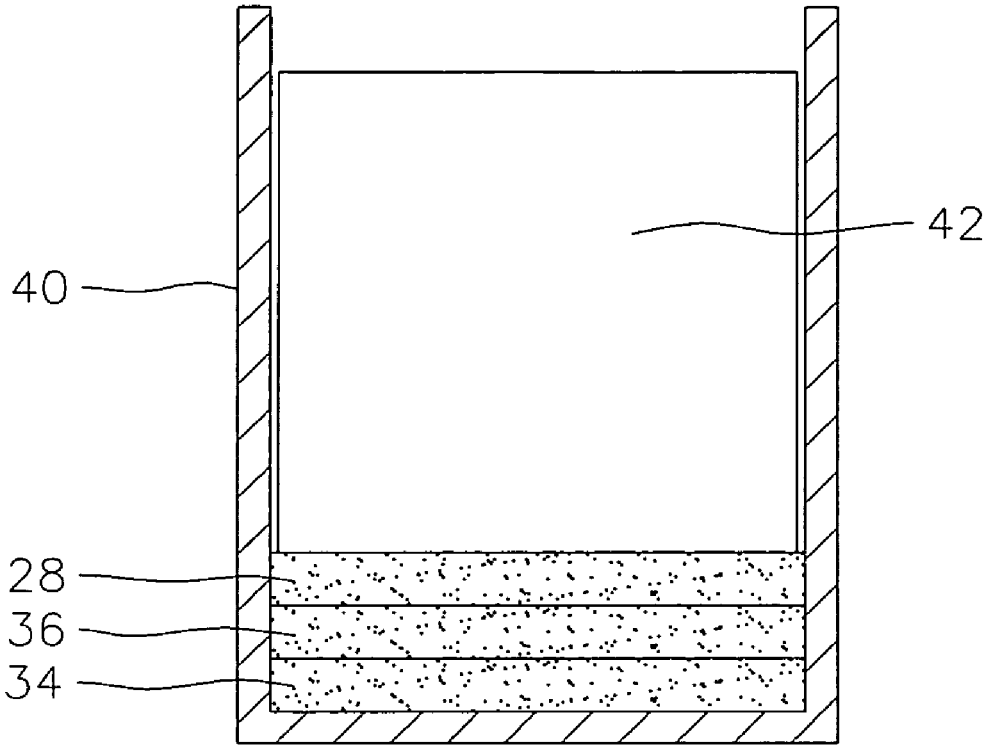
FIG. 5 is a partial cross-sectional view of an assembly including a refractory metal enclosure, ultra hard material layers and a substrate prior to sintering.

In another exemplary embodiment, an optimum combination of wear resistance, strength and toughness may be accomplished by forming a working surface layer 34 having diamond grains having an average grain size of between about 0.01 to about 2 microns, and more preferably between about 0.1 microns to about 0.2 microns; an intermediate layer 36 having diamond grains having an average grain size between about 3 microns to about 30 microns, and more preferably between about 8 microns to about 15 microns; and an interface surface layer 38 having a diamond average grain size of greater than about 40 microns to about 100 microns, but more preferably about 50 microns to about 70 microns, as for example shown in FIG. 5.

In yet another exemplary embodiment, an optimum combination of wear resistance, strength and toughness may be accomplished by forming a working surface layer 34 having diamond grains having an average grain size of between about 4 to about 30 microns, and more preferably between about 8 microns to about 15 microns; an intermediate layer 36 having diamond grains having an average grain size between about 40 microns to about 100 microns, and more preferably between about 50 microns to about 70 microns; and an interface surface layer 38 having a diamond average grain size of greater than about 100 microns, but more preferably greater than about 70 microns, as for example shown in FIG. 5.

Each layer may be formed from a powder of diamond grains and a binder, or using a tape material comprising diamond grains and a binder, as for example, a high shear compaction diamond tape. In exemplary embodiments the binder may be cobalt or silicone carbide.

The three layers may be formed or placed in a refractory sintering metal enclosure 40, such as a niobium enclosure commonly referred to as a can, adjacent a carbide substrate 42, as for example shown in FIG. 5. The enclosure with the layers, the substrate and a binder is capped using a cap made of the same material as the enclosure, and are sintered in an HPHT sintering process where diamond is thermodynamically stable. The sintering process converts the three layers into an ultra hard material layer having the gradient properties, i.e., the three layers 34, 36, 38 convert to the sections 27, 29 and 31, respectively, each having a distinct property, shown in FIG. 4. In an alternate exemplary embodiment, the substrate may be placed first in the can and the layers may then be placed over the substrate.

The ultra hard material layer may then be separated from the substrate and leached, if cobalt is used as the binder, to form a TSP material layer with the gradient properties, as shown in FIG. 4. The TSP layer may then be bonded to a carbide substrate to form a cutting element or other cutting tool using any of the aforementioned brazing methods or other appropriate brazing methods. In yet a further exemplary embodiment, the three layers are formed using a silicon carbide binder, and thus, leaching may not be necessary. With this embodiment, a cutting tool, such as a cutting element may be formed with an engineered gradient property TSP cutting layer 20 once the HPHT sintering is completed. In yet a further exemplary embodiment, each layer of TSP material may be formed individually and then bonded to the other layer(s) using any of the aforementioned or other appropriate brazing methods.

In another exemplary embodiment, the average grain size and density may increase from the working surface toward the interface surface. In yet a further exemplary embodiment, an entire TSP layer may have the same average grain size distribution throughout its thickness, but may have a density that increases from the working surface towards the interface surface. In a further exemplary embodiment, the TSP material is provided having the same average grain size throughout its thickness and a density that increases from the interface surface towards the working surface. In yet a further exemplary embodiment the TSP material may have the same grain size distribution throughout its thickness and different or various densities through its thickness. This can be achieved by selecting different grain size distributions and/or reduction temperatures and times for each layer or section of the TSP material in a direction from the interface surface to the working surface.

In another exemplary embodiment, an engineered TSP material may be provided having a gradient transverse rupture strength, i.e., a transverse rupture strength that varies through the thickness of the TSP material. For example, in one embodiment, the transverse rupture strength decreases or increases from the working surface to the interface surface of the engineered TSP layer.

The transverse rupture strength varies as a function of diamond grain size distribution, reduction temperatures and times, and HPHT conditions. Thus, the transverse rupture strength of the material may be varied through different sections of the material by varying the grain size distribution at such sections. With this exemplary embodiment, the TSP layer may be formed as one layer with multiple sections having different diamond grain sizes, as for example described with the exemplary embodiments shown in FIGS. 4 and 5 or may be formed as separate layers which are brazed to each other, each layer having a specific grain size distribution. In another exemplary embodiment, an engineered TSP material layer is provided having a grain size that increases or decreases from the working surface to the interface surface.

Figure 6:
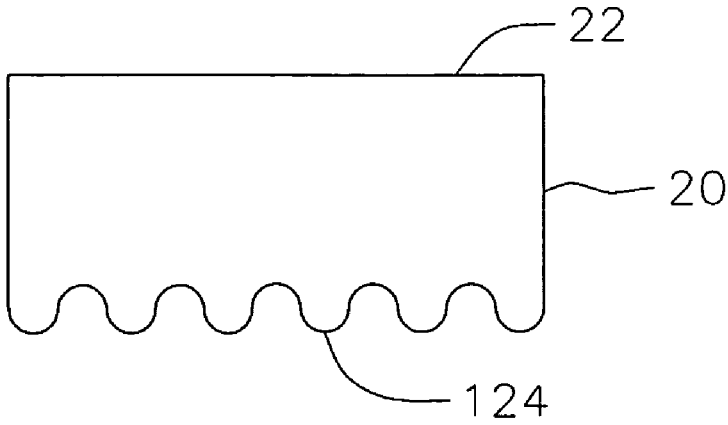
FIG. 6 is an end view of an exemplary embodiment TSP material of the present invention having a non-uniform interface surface.

Either of aforementioned exemplary embodiment TSP materials may have a non-uniform interface surface 124, as for example shown in FIG. 6 for interfacing with a substrate. As used herein, a "uniform" interface (or surface) is one that is flat or always curves in the same direction. This can be stated differently as an interface having the first derivative of slope always having the same sign. Thus, for example, a conventional polycrystalline diamond-coated cutting element for a rock bit has a uniform interface since the center of curvature of all portions of the interface is in or through the carbide substrate.

On the other hand, a "non-uniform" interface is defined as one where the first derivative of slope has changing sign. An example of a non-uniform interface is one that is wavy with alternating peaks and valleys. Other non-uniform interfaces may have dimples, bumps, ridges (straight or curved) or grooves, or other patterns of raised and lowered regions in relief.

Figure 7:
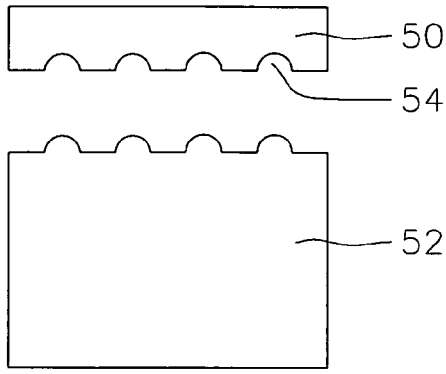
FIG. 7 is an exploded end view of a PCD layer and substrate used to form an exemplary embodiment TSP material.

In exemplary embodiments, the TSP may be initially formed as a polycrystalline diamond layer formed over a substrate using known sintering methods. In an exemplary embodiment where the TSP is required to have a non-uniform interface for interfacing with the substrate, a PCD layer 50 is formed over a substrate 52 having the desired non-uniform interface 54, as for example shown in FIG. 7 using known HPHT sintering methods. After sintering and the formation of the PCD layer on the substrate, the substrate is removed so as to expose the non-uniform interface. The PCD layer is then leached as necessary to form the appropriate TSP layer. In another exemplary embodiment, the PCD layer may be leached prior to being separated from its substrate. Either prior to leaching or after leaching, the PCD material may be cut to the appropriate size, if necessary.

In another exemplary embodiment, the TSP is formed with the appropriate silicone carbide binder on a tungsten carbide or other type of substrate, with the requisite, i.e., uniform or non-uniform, interface surface. The substrate is then removed so as to expose the TSP with the appropriate non-uniform interface surface.

Figure 8:
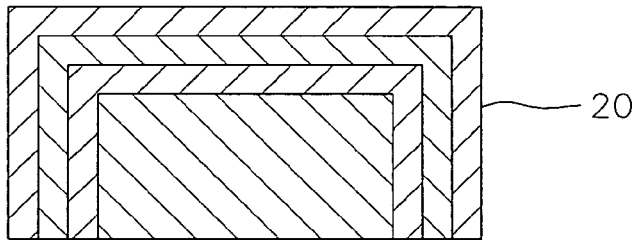
FIG. 8 is a cross-sectional view of exemplary embodiment engineered TSP material of the present invention.
Figure 9:
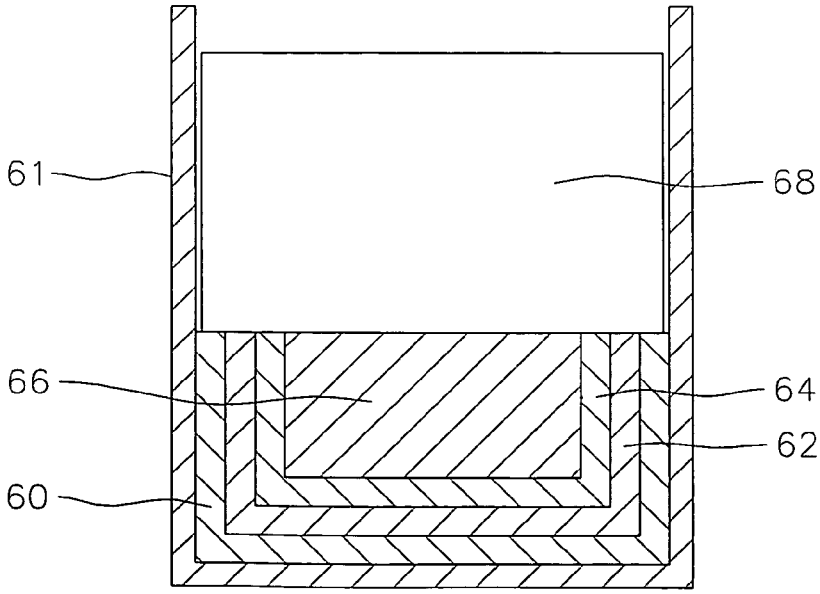
FIG. 9 is a cross-sectional view of an assembly including a refractory metal enclosure, various layers of ultra hard material and a substrate prior to sintering for forming the exemplary embodiment TSP material shown in FIG. 8.

In another exemplary embodiment the TSP material 20 may be formed having properties that are axially and radially gradient, as for example shown in FIG. 8. In an exemplary embodiment, this TSP material may be formed using various grain size diamond tape layers as for example shown in FIG. 9. For example, as shown in FIG. 9, a first tape layer 60 is draped in a refractory metal sintering enclosure. A second tape layer 62 is then draped within the first layer 60. A third tape layer 64 is draped within the second layer. A fourth tape layer 66 is placed within the third layer. Each of the layers may have different properties, as for example different average grain sizes or grain size distributions, as necessary. A substrate material 68 is placed over the layers and the can is capped. The capped can, layers and substrate including a binder are HPHT sintered converting the layers to an ultra hard material layer bonded to the substrate. After sintering is completed, the substrate is removed and the resulting polycrystalline diamond is leached if a cobalt binder was used, forming the TSP material. The TSP material may then be bonded using any of the aforementioned or any other well known suitable brazing techniques to a substrate. If a silicon carbide binder is used, instead of the cobalt binder, then leaching may not be necessary to form the TSP material.

Figure 10:
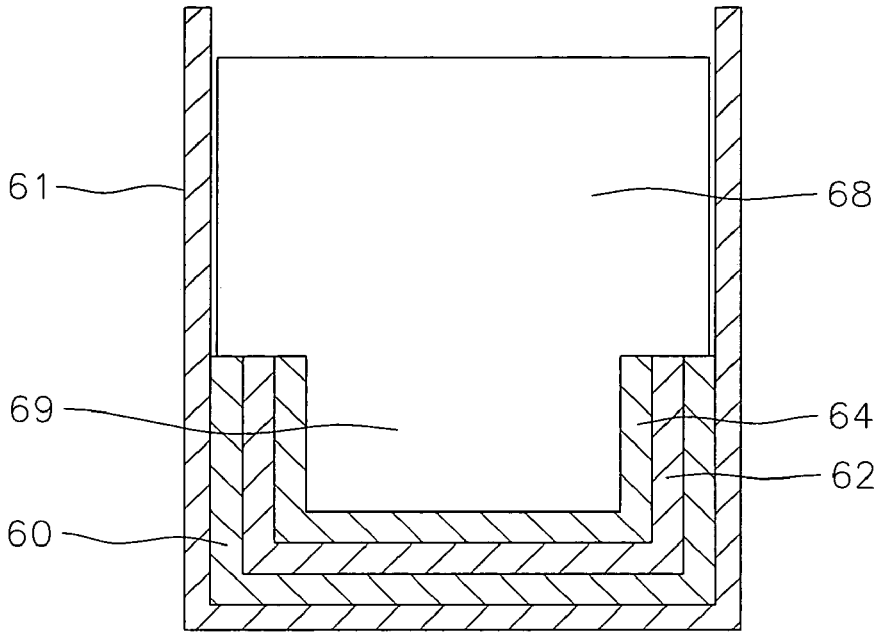
FIG. 10 is a cross-sectional view of an exemplary embodiment assembly of a refractory metal can, ultra hard material layers and substrate prior to sintering.

In another exemplary embodiment as shown in FIG. 10, the three layers 60, 62, 64 are draped within the can 61 and the substrate 68 is shaped to have a projection 69 which is fitted within layer 64 as shown in FIG. 10. In this regard, the layers 60, 62, 64 surround the projection 69.

Figure 11:
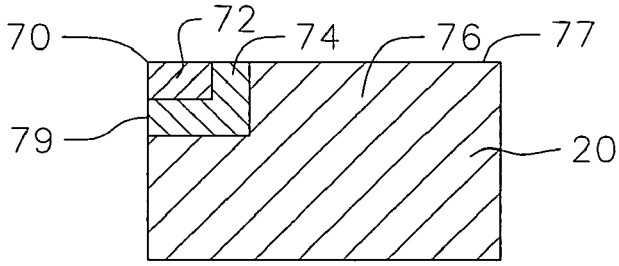
FIGS. 11 and 12 are cross-sectional views of other exemplary embodiment engineered TSP materials of the present invention.

In another exemplary embodiment, as shown in FIG. 11 an engineered TSP material layer 20 is provided having specific properties at one edge 70 thereof. This exemplary embodiment TSP material layer 20 comprises a first section 72 extending to an edge 70 extending along a portion of the cutting element periphery. A second section 74 is formed over the first section 72. A third section 76 is formed over the second section 74. Each of the three sections may have different properties so as to define a TSP material with gradient properties. Furthermore with this exemplary embodiment each section extends to a surface 77 and to a peripheral surface 79 of the TSP material layer. This TSP material may be formed with any of the aforementioned methods. For example, a strip of tape diamond may be placed at a corner of the refractory metal can to form the first section 72. A second layer of tape material may then be draped over the first layer to form the second section 74. A third layer may then be placed over the second layer to form the third section 76. The third layer may be in powder form. In alternate exemplary embodiments all or any of the three layers may be in powder or tape form. In another exemplary embodiment, only the first and second layers are placed in the can and then a substrate material is placed over the second layer in lieu of the third layer 76. In an exemplary embodiment, each layer has different properties from an adjacent layer. The assembly of layers, substrate, binder and can are HPHT sintered as described in relation to the other exemplary embodiments and the resulting PCD material is leached, if necessary, for forming a TSP material as described in relation to the aforementioned exemplary embodiments.

Figure 12:
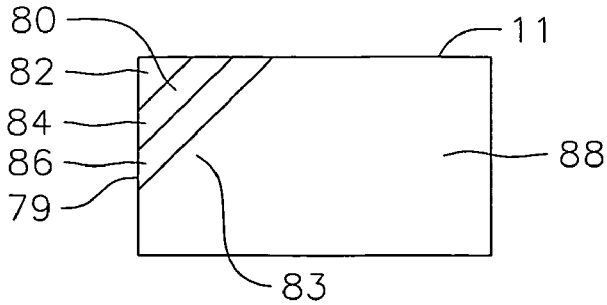

In a further exemplary embodiment, a TSP material is formed having gradient properties diagonally from an edge 80 or the TSP material as for example shown in FIG. 12. With this exemplary embodiment each section extends to a surface 77 and to a peripheral surface 79 of the TSP material layer. This type of TSP material may be formed by using powder or tape diamond material which is fitted in a corner of a sintering can to define a first corner layer 82. A second layer 84 layer is then formed or laid over the first layer along a plane generally perpendicular to diagonal axis 83 through the edge 80. A third layer 86 is then formed over the second layer along a plane generally perpendicular to diagonal axis 83. A fourth layer 88 is then formed over the third layer 86. The fourth layer may also be in tape form or may be in powder form. In other exemplary embodiments any or all layers are in tape or powder form. In an exemplary embodiment, each layer has different properties from an adjacent layer. A substrate material is then placed over the fourth layer and the entire assembly is sintered as described above for forming a TSP material. In an alternate exemplary embodiment, a substrate may be placed adjacent to third layer 86 and in lieu of layer 88.

With any of the aforementioned exemplary embodiments, more or less than the number of layers described in those embodiments may be used. For example, in the TSP material shown in FIG. 12, two layers or five layers may be used to form the TSP material instead of the four layers shown.

Figure 13:
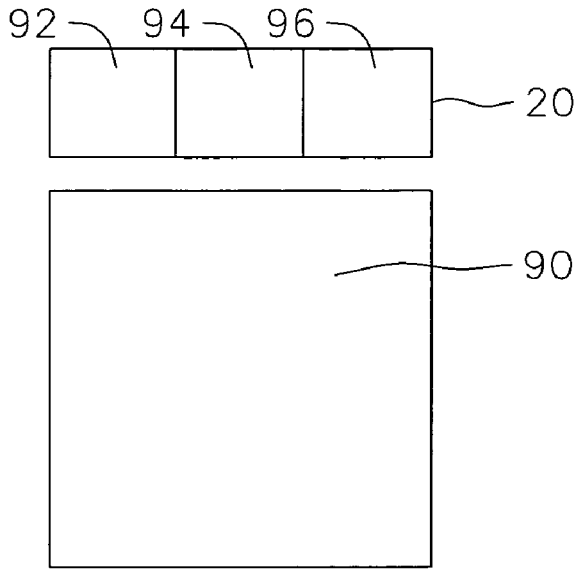
FIGS. 13 and 14 are exploded end views of other exemplary embodiment engineered TSP materials with corresponding substrates which may be bonded together to form exemplary embodiment cutting elements of the present invention.

In other exemplary embodiments, instead of forming a TSP material having gradient properties through the thickness of the TSP material, the TSP material may be engineered to have gradient properties across its width, as for example shown in FIG. 13. In the exemplary embodiment shown in FIG. 13, when forming the TSP material, the layers of diamond material are positioned adjacent each other across the TSP material layer. For example, the TSP material layer may be formed using three layers 92, 94 and 96 as shown in FIG. 13, each having different properties. In another exemplary embodiment, layers or strips 92 and 96 may have the same material properties, whereas layer 94, which is the middle layer, may have different properties. More or less than three layers may be used in other exemplary embodiments. The TSP material 20 may be bonded to a substrate 90, as for example shown in FIG. 13 using any of the aforementioned brazing methods or other known brazing or bonding materials.

Figure 14:
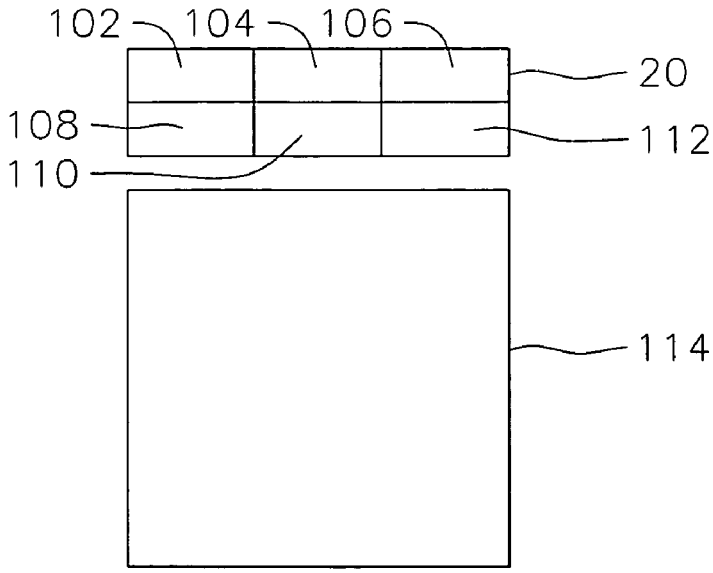

In another exemplary embodiment, the TSP material may have properties that vary axially and laterally, as for example as shown in FIG. 14. In this exemplary embodiment, TSP materials may be formed using multiple layers 102, 104, 106, 108, 110, 112 which are stacked vertically and horizontally as shown in FIG. 14. The properties of each such layer may vary from those of an adjacent layer so as to provide the appropriate gradient properties. This exemplary embodiment TSP 20 may be bonded onto a substrate 114 suing any of the aforementioned brazing methods or other known brazing or bonding methods.

In yet a further exemplary embodiment, the layers of materials shown in FIGS. 13 and 14 used to form the TSP material may be circular, annular, non-linear or linear in plan view. Moreover, each of the exemplary embodiment TSP materials shown in FIGS. 8, 10, 11, 12, 13 and 14 may be formed as separate individual TSP layers, each layer having desired properties, and then brazed together using any of the aforementioned brazing techniques. The properties of a TSP material or of a TSP layer used to form a TSP material may also be varied by varying the HPHT sintering temperatures and/or the diamond grain size distribution, and/or the average diamond grain size of the diamond grains used to form the TSP material.

Any of the exemplary TSP materials described herein may be used to form a first TSP material layer that is bonded to another TSP material layer which may be different or the same as the first TSP material layer. Moreover, any exemplary TSP material described herein may be formed to define a section or portion of a TSP material layer. For example, one of the TSP materials described in U.S. Pat. No. 4,636,253 may form a first section of an exemplary TSP material layer, while another TSP material may define an adjacent section of the exemplary TSP material layer. Furthermore, the interface between adjacent TSP sections of a TSP material layer or between bonded TSP layers forming a TSP material layer according to the present invention may be uniform or non-uniform.

In yet a further exemplary embodiment, any exemplary embodiment TSP material may be cut to form a section or sections of a cutting layer that would be bonded on to a cutting element or cutting tool. This section(s) may be used in lieu of, or adjacent to, an ultra hard material layer forming the cutting layer of a cutting element or cutting tool. In other exemplary embodiments, the geometry of the TSP materials may be formed by cutting the TSP material using known methods such as electrical discharge machining (EDM).

It should be noted that the term "substrate" as used herein means any body onto which the exemplary TSP materials are bonded to. For example a substrate may be the body of a cutting element or a transition layer bonded to the body onto which is bonded a TSP material layer.

Although the present invention has been described and illustrated to respect to multiple embodiments thereof, it is to be understood that it is not to be so limited, since changes and modifications may be made therein which are within the full intended scope of this invention as hereinafter claimed.

The invention claimed is:

1. A cutting element comprising:

a substrate; and a thermally stable polycrystalline diamond layer over the substrate, said thermally stable polycrystalline diamond layer comprising at least a property having a value that varies through said layer, wherein the thermally stable polycrystalline diamond layer comprises a transverse rupture strength of at least 150 kg/mm$^2$.

2. The cutting element as recited in claim 1 wherein the property value varies axially though the layer.

3. The cutting element as recited in claim 1 wherein the property value varies transversely across the layer.

4. The cutting element as recited in claim 1 wherein said property is selected from the group of properties consisting of material strength and transverse rupture strength.

5. The cutting element as recited in claim 1 wherein the thermally stable polycrystalline diamond layer property value varies in a radial direction.

6. The cutting element as recited in claim 1 wherein the thermally stable polycrystalline diamond layer comprises a thickness, and wherein the property value varies axially and radially through the thickness.

7. The cutting element as recited in claim 1 wherein the thermally stable polycrystalline diamond layer comprises a first section adjacent a second section, wherein the first section comprises diamond grains having a first average grain size, wherein the second section comprises diamond grains having a second average grain size, wherein the second average grain size is greater than the first average grain size.

8. The cutting element as recited in claim 7 wherein the thermally stable polycrystalline diamond layer further comprises a third section adjacent the second section, wherein the third section comprises diamond grains having a third average grain size, wherein the third average grain size is greater than the second average grain size.

9. The cutting element as recited in claim 8 wherein each section defines a layer, wherein the first section defined layer is further from the substrate than the second section defined layer which is further from the substrate than the third section defined layer, wherein the first average grain size is in the range of about 0.01 to about 2 microns, wherein the second average grain size is in the range of about 3 to about 30 microns, and wherein the third average grain size is in the range of about 40 to about 100 microns.

10. The cutting element as recited in claim 8 wherein each section defines a layer, wherein the first section defined layer is further from the substrate than the second section defined layer which is further from the substrate than the third section defined layer, wherein the first average grain size is in the range of about 0.1 to about 0.2 microns, wherein the second average grain size is in the range of about 8 to about 15 microns, and wherein the third average grain size is in the range of about 50 to about 70 microns.

11. The cutting element as recited in claim 8 wherein each section defines a layer, wherein the first section defined layer is further from the substrate than the second section defined layer which is further from the substrate than the third section defined layer, wherein the first average grain size is in the range of about 4 to about 30 microns, wherein the second average grain size is in the range of about 40 to about 100 microns, and wherein the third average grain size is greater than about 100 microns.

12. The cutting element as recited in claim 8 wherein each section defines a layer, wherein the first section defined layer is further from the substrate than the second section defined layer which is further from the substrate than the third section defined layer, wherein the first average grain size is in the range of about 8 to about 15 microns, wherein the second average grain size is in the range of about 50 to about 70 microns, and wherein the third average grain size is greater than about 70 microns.

13. The cutting element as recited in claim 8 wherein each section defines a layer, wherein the third section defines a layer closest to the substrate, wherein the second section is formed over the third section, and wherein the first section is formed over the second section.

14. The cutting element as recited in claim 8 wherein the first section encapsulates the second section and wherein the second section encapsulates the third section.

15. The cutting element as recited in claim 8 wherein the three sections extend side by side defining the thermally stable polycrystalline diamond layer.

16. The cutting element as recited in claim 1 wherein the thermally stable polycrystalline diamond layer comprises a first section adjacent a second section, wherein the first section comprises a first porosity, wherein the second section comprises a second porosity greater than the first porosity.

17. The cutting layer as recited in claim 16 wherein the thermally stable polycrystalline diamond layer further comprises a third section having a third porosity greater than the second porosity.

18. The cutting element as recited in claim 17 wherein each section defines a sub-layer, wherein the first section defines a first sub-layer, wherein the second section defines a second sub-layer, wherein the third section defines a third sub-layer, wherein the second sub-layer is over the third sub-layer, wherein the first sub-layer is over the second sub-layer, wherein the first sub-layer has a porosity in the range of about 1% to about 7%, wherein the second sub-layer has a porosity in the range of about 7% to about 11% and wherein the third sub-layer has a porosity that is greater than about 11%.

19. The cutting element as recited in claim 18 wherein the three sub-layers define a thermally stable polycrystalline diamond cutting layer having a first surface and second surface opposite the first surface, wherein the second surface is closer to the substrate and wherein the first sub-layer defines the first surface, wherein the first sub-layer has a thickness that extends axially from the first surface to a depth of no greater than about 0.2 mm, wherein the second sub-layer has a thickness that extends axially from the first sub-layer to a depth of no greater than about 1 mm as measured from the first surface, and wherein the third sub-layer has a thickness that extends from the second sub-layer.

20. The cutting element as recited in claim 1 wherein the thermally stable polycrystalline diamond layer comprises diamond grains having a grain size in the range of about 10 about 100 microns.

21. The cutting element as recited in claim 1 wherein the thermally stable polycrystalline diamond layer comprises a transverse rupture strength of at least 180 kg/mm$^2$.

22. The cutting element as recited in claim 1 wherein the thermally stable polycrystalline diamond material comprises a transverse rupture strength of at least 200 kg/mm$^2$.

23. The cutting element as recited in claim 1 wherein the thermally stable polycrystalline diamond layer comprises in the range of 20% to 95% by volume diamond grains having a grain size no greater than 1 micron.

24. The cutting element as recited in claim 1 wherein the thermally stable polycrystalline diamond layer comprises in the range of 90% to 99% diamond grains.

25. The cutting element as recited in claim 1 wherein the thermally stable polycrystalline diamond layer comprises a first surface opposite a second surface, wherein the first surface is farther from the substrate than the second surface, and wherein the thermaily stable polycrystalline diamond layer comprises diamond grains proximate the first surface and diamond grains proximate the second surface, wherein the diamond grains proximate the second surface have a higher average grain size than the diamond grains proximate the first surface.

26. The cutting element as recited in claim 1 wherein the density of the thermally stable polycrystalline diamond layer varies in an axial direction.

27. The cutting element as recited in claim 1 wherein the substrate comprises a projection, wherein the thermally stable polycrystalline diamond layer surrounds said projection.

28. The cutting element as recited in claim 27 wherein the thermally stable polycrystalline diamond layer comprises a plurality of sub-layers, wherein each sub-layer has said property having a value different from a value of the same property of an adjacent sub-layer, wherein each sub-layer surrounds said projection.

29. The cutting element as recited in claim 1 wherein the thermally stable polycrystalline diamond layer comprises at least two sections, wherein each section comprises said property wherein the value of said property in the first section is different from the value of said property in the second section.

30. The cutting element as recited in claim 29 wherein the value of each property is constant in each section.

31. The cutting element as recited in claim 29 wherein the thermally stable polycrystalline diamond layer comprises an edge, wherein said second section defines at least a portion of said edge.

32. The cutting element as recited in claim 29 wherein said layer comprises an upper surface and a peripheral surface extending along a periphery of said layer, wherein each of the sections extends to both the upper surface and to the peripheral surface.

33. The cutting element as recited in claim 29 wherein the layer further comprises a third section, wherein the third section comprises said property having a value different from the value of said property in the first and second sections, wherein said layer comprises an upper surface and a peripheral surface extending along a periphery of said layer, wherein each of section extends to both the upper surface and to the peripheral surface.

34. A drill bit comprising a body and cutting element as recited in claim 1 mounted thereon.

35. A cutting element comprising:

a substrate; and a cutting layer formed over the substrate, said cutting layer comprising a portion defining a cutting edge, said portion being formed from a thermally stable polycrystalline diamond material comprising at least a property having a value that varies through said thermally stable polycrystalline diamond material, wherein the thermally stable polycrystalline diamond material comprises a transverse rupture strength of at least 150 kg/mm$^2$.

36. The cutting element as recited in claim 35 wherein only said portion of said cutting layer is formed from said thermally stable polycrystalline diamond material.

37. A drill bit comprising a body and cutting element as recited in claim 35 mounted thereon.

38. The cutting element as recited in claim 1 wherein said layer comprises a plurality of separate layers bonded together.

39. A cutting element comprising:

a substrate; and a thermally stable polycrystalline diamond layer over the substrate, said thermally stable polycrystalline diamond layer comprising at least a property having a value that varies through said layer, wherein the thermally stable polycrystalline diamond layer comprises a first section adjacent a second section, wherein the first section comprises diamond grains having a first average grain size, wherein the second section comprises diamond grains having a second average grain size, wherein the second average grain size is greater than the first average grain size, wherein the thermally stable polycrystalline diamond layer comprises a third section adjacent the second section, wherein the third section comprises diamond grains having a third average grain size, wherein the third average grain size is greater than the second average grain size.

40. The cutting element as recited in claim 39 wherein each section defines a layer, wherein the first section defined layer is further from the substrate than the second section defined layer which is further from the substrate than the third section defined layer, wherein the first average grain size is in the range of about 0.01 to about 2 microns, wherein the second average grain size is in the range of about 3 to about 30 microns, and wherein the third average grain size is in the range of about 40 to about 100 microns.

41. The cutting element as recited in claim 39 wherein each section defines a layer, wherein the first section defined layer is further from the substrate than the second section defined layer which is further from the substrate than the third section defined layer, wherein the first average grain size is in the range of about 0.1 to about 0.2 microns, wherein the second average grain size is in the range of about 8 to about 15 microns, and wherein the third average grain size is in the range of about 50 to about 70 microns.

42. The cutting element as recited in claim 39 wherein each section defines a layer, wherein the first section defined layer is further from the substrate than the second section defined layer which is further from the substrate than the third section defined layer, wherein the first average grain size is in the range of about 4 to about 30 microns, wherein the second average grain size is in the range of about 40 to about 100 microns, and wherein the third average grain size is greater than about 100 microns.

43. The cutting element as recited in claim 39 wherein each section defines a layer, wherein the first section defined layer is further from the substrate than the second section defined layer which is further from the substrate than the third section defined layer, wherein the first average grain size is in the range of about 8 to about 15 microns, wherein the second average grain size is in the range of about 50 to about 70 microns, and wherein the third average grain size is greater than about 70 microns.

44. The cutting element as recited in claim 39 wherein each section defines a layer, wherein the third section defines a layer closest to the substrate, wherein the second section is formed over the third section, and wherein the first section is formed over the second section.

45. The cutting element as recited in claim 39 wherein each section is formed as layer and wherein said sections are bonded together.

46. A cutting element comprising:

a substrate; and a thermally stable polycrystalline diamond layer over the substrate, said thermally stable polycrystalline diamond layer comprising at least a property having a value that varies through said layer, wherein the thermally stable polycrystalline diamond layer comprises a first section adjacent a second section, and a third section, wherein the first section comprises a first porosity, wherein the second section comprises a second porosity greater than the first porosity, and wherein the third section comprises a third porosity greater than the second porosity.

47. The cutting element as recited in claim 46 wherein each section defines a sub-layer, wherein the first section defines a first sub-layer, wherein the second section defines a second sub-layer, wherein the third section defines a third sub-layer, wherein the second sub-layer is over the third sub-layer, wherein the first sub-layer is over the second sub-layer, wherein the first sub-layer has a porosity in the range of about 1% to about 7%, wherein the second sub-layer has a porosity in the range of about 7% to about 11% and wherein the third sub-layer has a porosity that is greater than about 11%.

48. The cutting element as recited in claim 47 wherein the three sub-layer define a thermally stable polycrystalline diamond cutting layer having a first surface and second surface opposite the first surface, wherein the second surface is closer to the substrate and wherein the first sub-layer defines the first surface, wherein the first sub-layer has a thickness that extends axially from the first surface to a depth of no greater than about 0.2 mm, wherein the second sub-layer has a thickness that extends axially from the first sub-layer to a depth of no greater than about 1 mm as measured from the first surface, and wherein the third sub-layer has a thickness that extends from the second sub-layer.

49. A cutting element comprising:

a substrate; and a thermally stable polycrystalline diamond layer over the substrate, said thermally stable polycrystalline diamond layer comprising at least a property having a value that varies through said layer, wherein the thermally stable polycrystalline diamond layer comprises a transverse rupture strength in the range of 150 $kg/mm^2$ to about 200 $kg/mm^2$.

50. A cutting element comprising:

a substrate; and a thermally stable polycrystalline diamond layer over the substrate, said thermally stable polycrystalline diamond layer comprising at least a property having a value that varies through said layer, wherein the thermally stable polycrystalline diamond layer comprises in the range of 20% to 95% by volume diamond grains having a grain size no greater than 1 micron.

51. A cutting element comprising:

a substrate; and a thermally stable polycrystalline diamond layer over the substrate, said thermally stable polycrystalline diamond layer comprising at least a material property having a value that varies through said layer, wherein the thermally stable polycrystalline diamond layer comprises in the range of 95% to 99% diamond grains.

52. The cutting element as recited in claim 51 wherein the thermally stable polycrystalline diamond layer comprises an interface surface opposite a working surface, said interface surface interfacing with the substrate, wherein said at least a property only increases or only decreases in value from said working surface to said interface surface.

* * * * *

UNITED STATES PATENT AND TRADEMARK OFFICE

CERTIFICATE OF CORRECTION

PATENT NO. : 7,694,757 B2
APPLICATION NO. : 11/361079
DATED : April 13, 2010
INVENTOR(S) : Madapusi K. Keshavan It is certified that error appears in the above-identified patent and that said Letters Patent is hereby corrected as shown below:

| | |
|---|---|
| Column 11, Claim 2, line 44 | Delete "though" Insert -- through -- |
| Column 13, Claim 20, line 17 | After "10" Insert -- to -- |
| Column 13, Claim 24, line 31 | Delete "90%" Insert -- 95% -- |
| Column 13, Claim 25, line 36 | Delete "thermaily" Insert -- thermally -- |
| Column 15, Claim 45, line 25 | After "as" Insert -- a -- |
| Column 16, Claim 47, line 4 | Delete "sub-layer" Insert -- sub-layers -- |

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,694,757 B2
APPLICATION NO. : 11/361079
DATED : April 13, 2010
INVENTOR(S) : Madapusi K. Keshavan It is certified that error appears in the above-identified patent and that said Letters Patent is hereby corrected as shown below:

In the Claims

Column 16, Claim 48, line 4 — Delete "sub-layer"

Insert -- sub-layers --

Signed and Sealed this
Twenty-second Day of July, 2014

Michelle K. Lee

Michelle K. Lee
*Deputy Director of the United States Patent and Trademark Office*